US008011961B2

(12) United States Patent
Liu et al.

(10) Patent No.: US 8,011,961 B2
(45) Date of Patent: Sep. 6, 2011

(54) CABLE ASSEMBLY WITH GROUNDING PIECES

(75) Inventors: Heng Liu, Shenzhen (CN); Xian-Kui Shi, Shenzhen (CN); Chung-Yen Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/579,424

(22) Filed: Oct. 15, 2009

(65) Prior Publication Data

US 2010/0093219 A1 Apr. 15, 2010

(30) Foreign Application Priority Data

Oct. 15, 2008 (CN) ..... 2008 2 0302435

(51) Int. Cl.
*H01R 13/649* (2006.01)

(52) U.S. Cl. ..... 439/607.58

(58) Field of Classification Search ..... 439/607.58, 439/607.28, 607.08, 545, 564, 79
See application file for complete search history.

(56) References Cited

U.S. PATENT DOCUMENTS 6,210,216 B1 * 4/2001 Tso-Chin et al. ..... 439/545
6,799,997 B2 * 10/2004 Lin et al. ..... 439/607.51
7,315,444 B2 1/2008 Chen et al.

FOREIGN PATENT DOCUMENTS

TW M243805 9/2004

* cited by examiner

*Primary Examiner* — Alexander Gilman
(74) *Attorney, Agent, or Firm* — Wei Te Chung; Andrew C. Cheng; Ming Chieh Chang

(57) ABSTRACT

A cable assembly comprises an insulative housing defining a first and second receiving room therein, and a mounting platform disposed at one side of the insulative housing. A first and second electrical connectors are respectively received into the first and second receiving rooms, the first electrical connector defines a metallic shell. At least one cable is electrically connected with the first and second electrical connectors. And a grounding piece is assembled to the mounting platform of the insulative housing and has a contacting arm received into the first receiving room and electrically contacted with the metallic shell of the first electrical connector.

17 Claims, 5 Drawing Sheets

CABLE ASSEMBLY WITH GROUNDING PIECES

FIELD OF THE INVENTION

The present invention relates to cable assembly, particularly to a cable assembly integrating a plurality of I/O connectors together and with good effectiveness of EMI shielding.

DESCRIPTION OF PRIOR ART

Currently the I/O connecting ports, such as USB connecting port and audio I/O port, are installed on front panel of PC case. Thus, the users can insert, connected, or expand peripherals easily.

TW Pat. No. M243805 issued on Sep. 11, 2004 discloses a cable assembly comprising an insulative housing, a plurality of connectors disposed in the insulative housing and a metallic shell surrounding the insulative housing. The insulative housing comprises an upper cover and a lower cover assembled to the upper cover. The cable assembly is easily to be assembled and disassembled, when a connector disposed in the insulative housing is damaged, it can be replaced by a new connector conveniently. Each connector defines a shell for electrically contacting with an outside grounding loop to achieve an effectiveness of EMI shielding. However, the grounding design of the cable assembly is complicated. For example, the metallic shell is difficult to form and assembled to the insulative housing.

As discussed above, an improved cable assembly overcoming the shortages of existing technology is needed.

SUMMARY OF THE INVENTION

Accordingly, an object of the present invention is to provide a cable assembly with a simple structure and convenient to achieve a good effectiveness of EMI shielding.

In order to achieve the above-mentioned objects, a cable assembly comprises an insulative housing defining a first and second receiving room therein, and a mounting platform disposed at one side of the insulative housing. A first and second electrical connectors are respectively received into the first and second receiving rooms, the first electrical connector includes a metallic shell. At least one cable is electrically connected with the first and second electrical connectors. And a grounding piece is assembled to the mounting platform of the insulative housing and has a contacting arm received into the first receiving room and electrically contacted with the metallic shell of the first electrical connector.

Other objects, features and advantages of the invention will be apparent from the following detailed description taken in connection with the accompanying drawings.

DETAILED DESCRIPTION OF PREFERRED EMBODIMENTS

Figure 1:
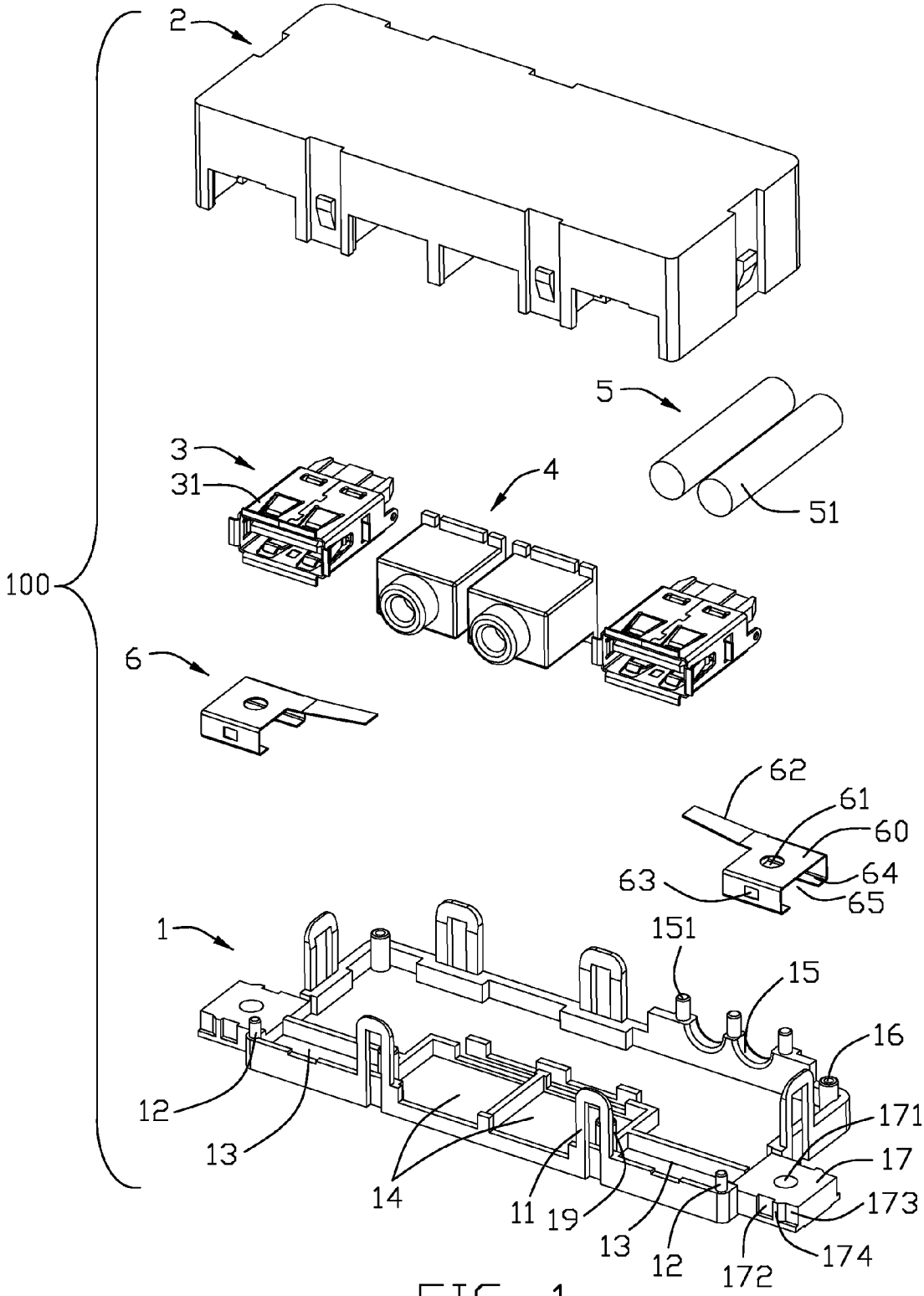
FIG. 1 is an exploded, perspective view of a cable assembly in accordance with the present invention.

Reference will now be made to the drawing figures to describe the present invention in detail.

Figure 5:
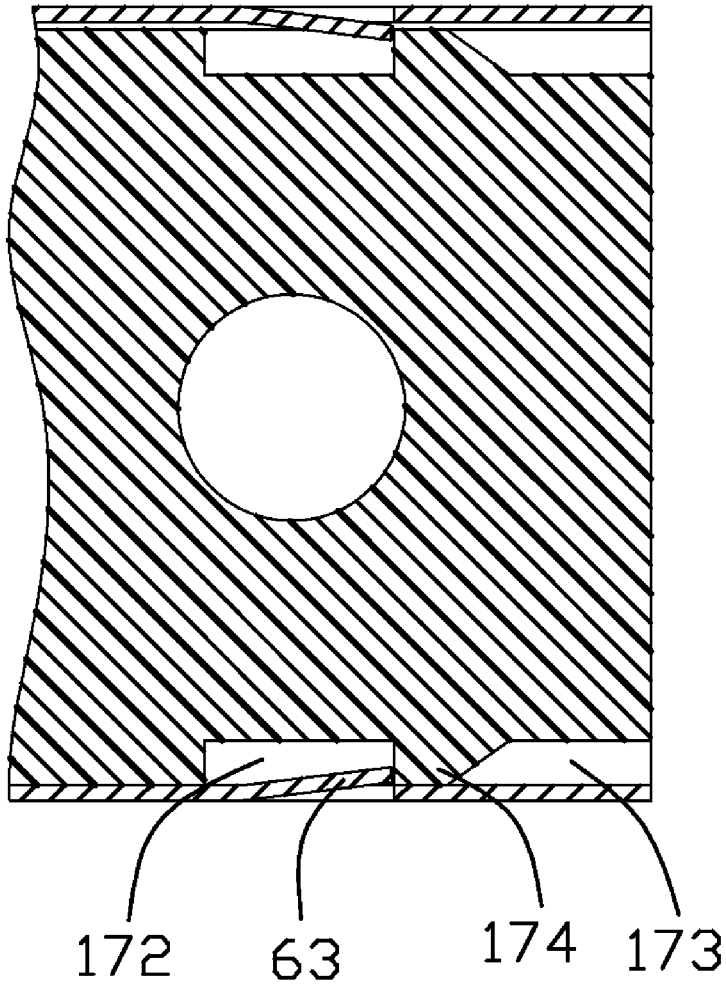
FIG. 5 is a partial cross-sectional view of the cable assembly taken along line 5-5 of FIG. 3.

Referring to FIGS. 1 and 5, a cable assembly in accordance with the present invention, generally designated 100, is adapted for mating with a plurality of complementary connectors (not shown). The cable assembly 100 includes an insulative housing defined by a lower cover 1 and an upper cover 2, a pair of first electrical connectors 3, a pair of second electrical connectors 4, two cables 5 and a pair of grounding pieces 6. The first electrical connector 3 has a metallic shell 31. In the embodiment shown, the first electrical connectors 3 are typical standard Universal Serial Bus (USB) connectors and the second electrical connectors 4 are audio jack connectors. However, in alternative embodiments, the electrical connectors could be provided with any suitable types connectors.

Figure 2:
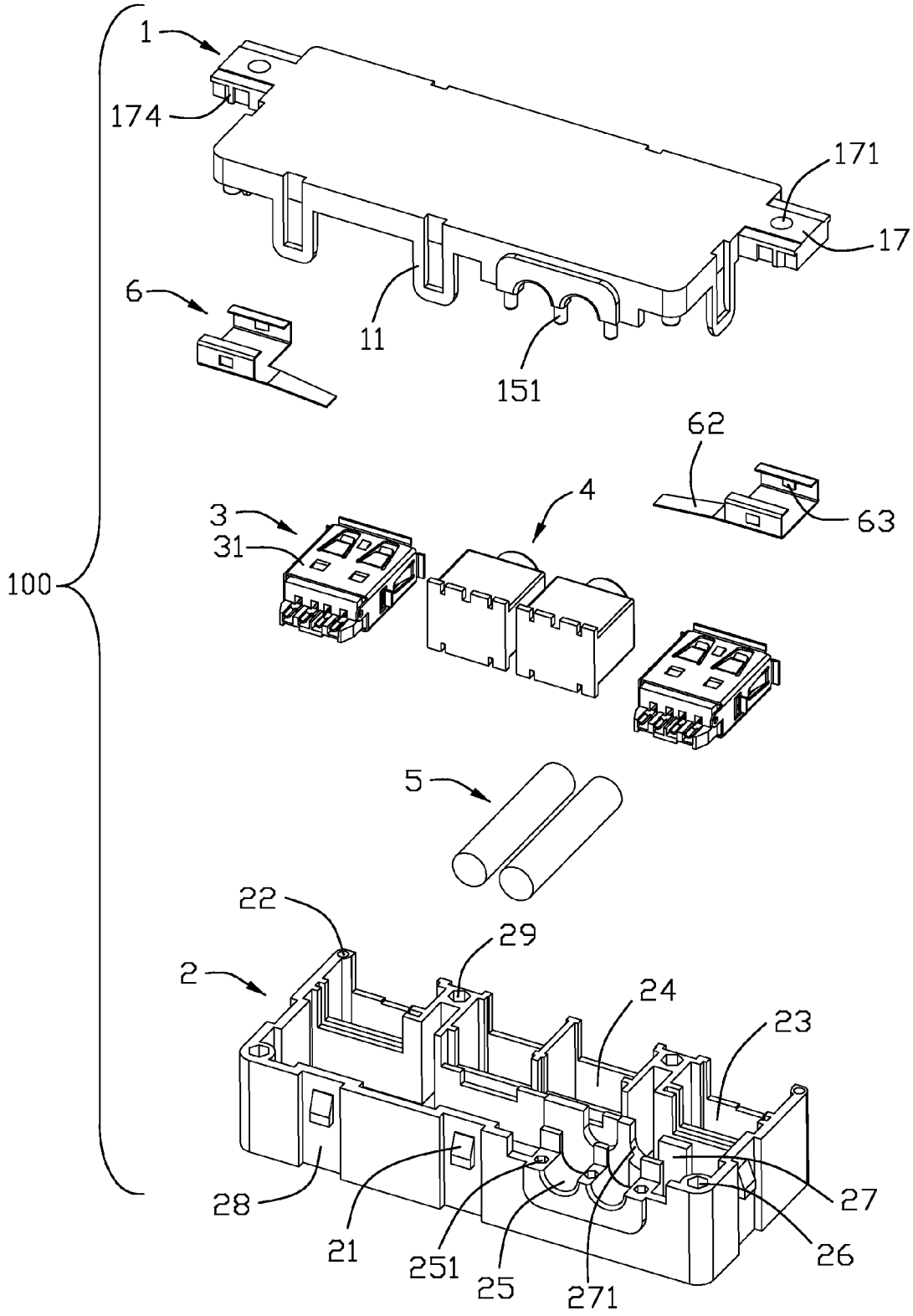
FIG. 2 is similar to FIG. 1, but viewed from another aspect.

Referring to FIG. 1 in conjunction with FIG. 2, the lower cover 1 comprises a bottom wall, a pair of side walls and a front and a rear walls. A plurality of latching portions 11 are respectively formed on the front, rear and side walls. A pair of first positioning posts 12 are formed on top surface of two corners of the side walls and front wall. A pair of first grooves 13 are formed on an upper surface of the bottom wall of the lower cover 1. A pair of second grooves 14 are also formed on the upper surface of the bottom wall of the lower cover 1 and disposed between the pair of the first grooves 13 in a widthwise direction. A second positioning post 19 is located between the first groove 13 and the second groove 14 in a widthwise direction. A pair of first through slots 15 are formed on the rear wall for supporting the cables 5. The first through slots 15 are all in a semicircular shape. A plurality of third positioning posts 151 are formed on the rear wall and adjacent to the first through slots 15. A pair of fourth positioning posts 16 are formed on the upper surface of the bottom wall of the lower cover 1 and disposed at two rear corners of the lower cover 1. A pair of mounting platforms 17 extends outwardly from two sides of the side wall. Each mounting platform 17 is located between the latching portion 11 and the first positioning post 12 in a longitudinal direction. Each mounting platform 17 defines a through mounting hole 171 extending in a vertical direction. A fixing slot 172 and a guiding slot 173 are respectively formed on a front and rear surface of the mounting platforms 17 and spaced by a rib 174.

The upper cover 2 comprises a top wall, a pair of side walls and a front and a rear walls. The upper cover 2 defines a pair of first positioning holes 22 formed at two front ends of the pair of side walls for receiving the corresponding first positioning posts 12, and a pair of fourth positioning holes 26 formed at two rear ends of the pair of side walls for receiving the corresponding fourth positioning posts 16. The first through slots 15 are all in a hexagonal shape. The upper cover 2 further defines a pair of third groove 23 formed on a bottom surface of the top wall and facing to the corresponding first grooves 13 in a vertical direction, and a pair of fourth grooves 24 formed on a bottom surface of the top wall and facing to the corresponding second grooves 14. The upper cover 2 defines a second positioning hole 29 located between the third groove 23 and fourth groove 24 for receiving the corresponding second positioning post 19. The second positioning holes 29 are all in a hexagonal shape. The upper wall 2 also defines a pair of second through slots 25 formed at rear wall and facing to the first through slots 15 in a vertical direction. The second through slot 25 is also in a semicircular shape. Three third positioning holes 251 are also formed in the rear wall for receiving the third positioning posts 151 and spaced by the pair of second through slots 25 in a widthwise direction. A supporting plate 27 is formed on a bottom surface of the top wall and defines a pair of receiving slots 271 in alignment with the pair of second through slots 25 in a front to rear direction. A plurality of vertical slots 28 are respectively formed on outer surfaces of the front wall, the pair of side walls and the rear wall of the upper cover 2. Each vertical slot 28 defines an engaging piece 21 therein for cooperating with the latching portion 11.

Also referring to FIG. 1, the cable 5 comprises an insulative layer 51 and a plurality of conductive wires (not shown), each conductive wire defines a conductor (shown) for signal transmitting.

Referring to FIGS. 1 and 5, each grounding piece 6 has a body portion 60, a contacting arm 62 formed at one side of the body portion 60. The body portion 60 defines a top wall having a through hole 61 in alignment with the mounting hole 171 of the mounting platform 17 in a vertical direction and a front and rear wall extending downward from a front and rear edge of the top wall. The front and wall respectively has a locking tab 63 cooperating with the fixing slot 172 of the mounting platform 17. The front and rear wall of the body portion 60 respectively has a extending portion 64 paralleled with the top wall. A rectangular receiving room 65 is formed by the top wall, the front and the rear wall of the body portion 60 for receiving the mounting platform 17.

Figure 3:
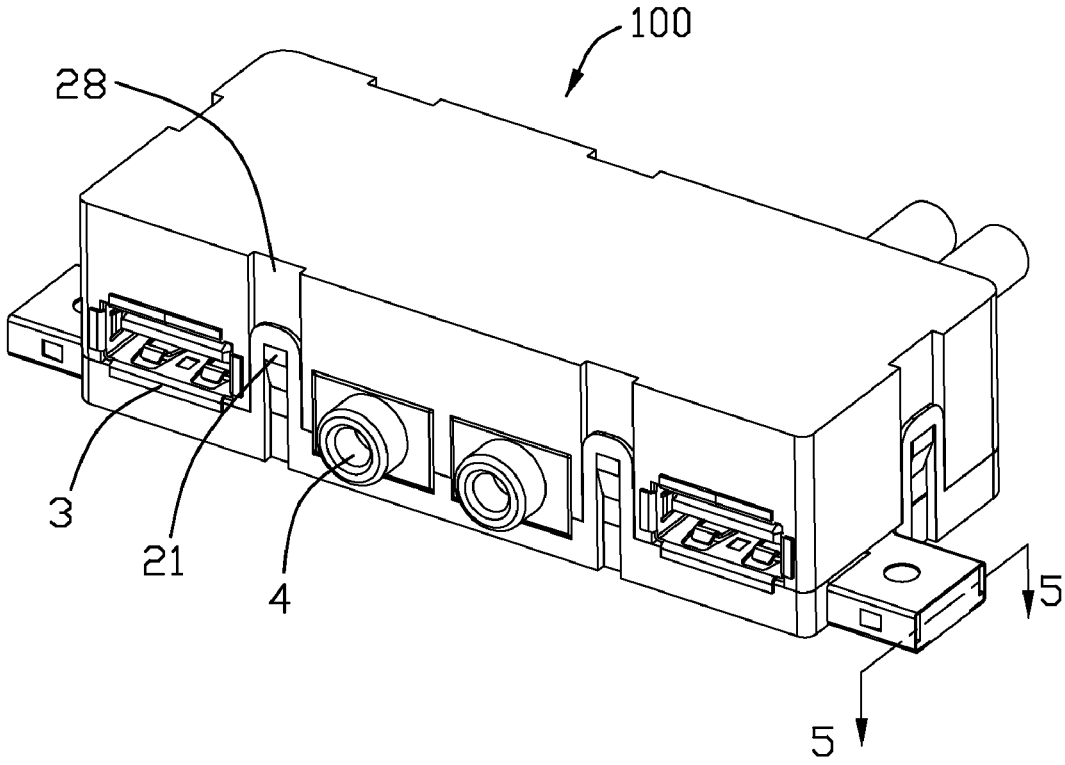
FIG. 3 is a perspective view of the cable assembly in accordance with the present invention.
Figure 4:
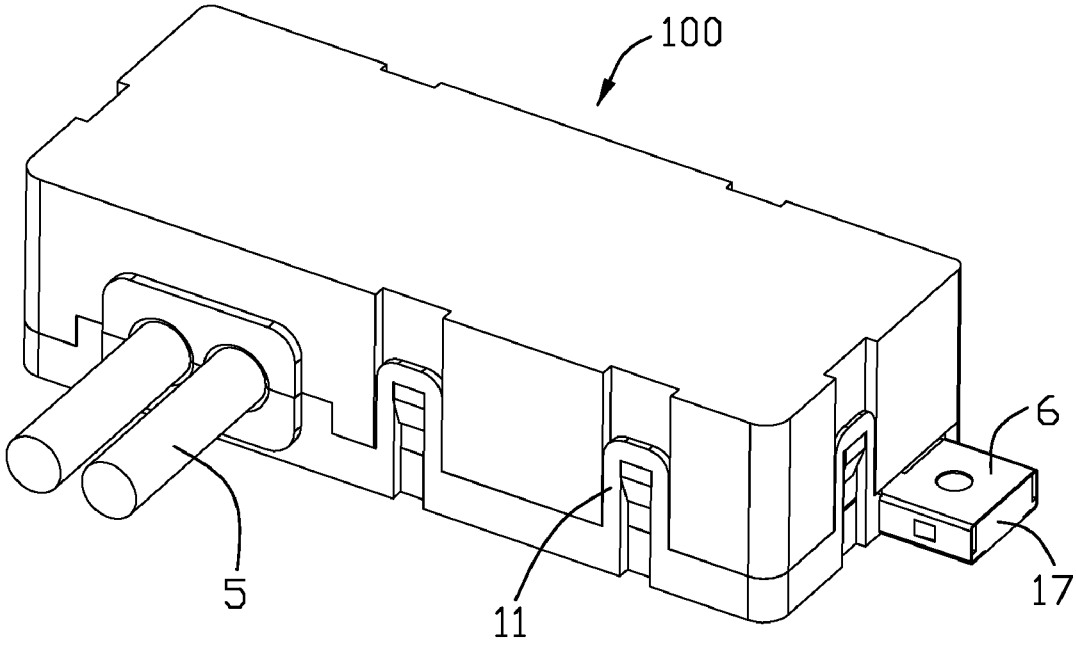
FIG. 4 is similar to FIG. 3, but viewed from another aspect.

In assembly, as shown in FIGS. 3 and 4 in conjunction with FIGS. 1 to 2 and 5, the pair of first electrical connectors 3 and the pair of second electrical connectors 4 respectively terminated with the cables 50 with the terminals (not labeled) thereof respectively soldered to the corresponding conductors (not shown) of the cables 50 which is well known for persons skilled in the art and the detailed description is omitted here.

Subsequently, assembling each grounding piece 6 to the lower cover 1. The body portion 60 of the grounding piece 6 surrounds the mounting platform 17. The contacting arm 62 of the grounding piece 6 is received into the first groove 13. The body portion of the grounding piece 6 engages with the mounting platform 17 through the locking tab 63 received into the fixing slot 172. The through hole 61 of the body portion 60 is in alignment with the mounting hole 171 of the platform 17 in a vertical direction.

Then, the pair of first electrical connectors 3 and the pair of the second electrical connectors 4 are respectively located into the pair of first grooves 103 and the pair of second grooves 104 of the lower cover 1 in a up-to-down direction with the mating ports (not figured) thereof exposed away a front surface of the lower cover 1. Correspondingly, the cables 5 extend rearward through the pair of first through slots 11 and are beyond a rear surface of the lower cover 1. Thus, the contacting arm 62 of each grounding piece 6 electrically contacts with a metallic shell 31 of first electrical connector 3.

At last, the upper cover 2 is assembled to the lower cover 1, the first, second, third and fourth positioning posts 12, 19, 151, 16 are respectively received into the first, second, third and fourth positioning holes 22, 29, 251, 26. Each latching portion 11 of the lower cover 1 is received into the vertical slots 28 and engaged with the engaging piece 21 to make the upper cover 2 locked with the lower cover 1. At this time, the first electrical connector 3 is received into a first receiving room formed by the first and third grooves 13, 23. The second electrical connector 4 is received into a second receiving room formed by the second and fourth grooves 14, 24.

Through the above assembling steps, as shown in FIGS. 3 to 4, the cable assembly 1 is accomplished.

In addition, the first and second electrical connectors 3, 4 of the cable assembly 100 are adapted for mating with a plurality of complementary connectors (not shown). A corresponding screw (not shown) passes through the through hole 61 of the grounding piece 6 and the mounting hole 171 of the mounting platform 17 for fastening the cable assembly 100 to a panel of the computer. Thus, the grounding piece 6 is electrically contacted with an outside grounding loop to achieve an good effectiveness of EMI shielding for the cable assembly 100. So, the cable assembly 100 has an effectiveness of EMI shielding through the pair of grounding pieces 6 which has a simple structure and can be easily assembled to the insulative housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing defining a first and second receiving rooms therein and a mounting platform extending along a lateral direction from one side of the insulative housing;

a first and second electrical connectors respectively received into the first and second receiving rooms, the first electrical connector including a metallic shell;

at least one cable electrically connected with the first and second electrical connector; and a grounding piece assembled and positioned to the mounting platform, and having a contacting arm received into the first receiving room and electrically contacted with the metallic shell of the first electrical connector.

2. The cable assembly as recited in claim 1, wherein the insulative housing includes a lower cover and an upper cover locked with the lower cover.

3. The cable assembly as recited in claim 1, wherein the grounding piece further defines a body portion surrounding the mounting platform, and the contacting arm extending into the first receiving room from the body portion along a lateral direction.

4. The cable assembly as recited in claim 2, wherein the lower cover has a plurality of positioning posts, the upper cover has a plurality of positioning holes, the positioning posts are received into the positioning holes.

5. The cable assembly as recited in claim 2, wherein the lower cover has a plurality of latching portions engaged with a plurality of corresponding engaging piece formed on the upper cover.

6. The cable assembly as recited in claim 3, wherein the body portion of the grounding piece further defines a pair of locking tabs respectively received into a pair of fixing slots of the mounting platform.

7. The cable assembly as recited in claim 2, wherein the lower cover defines a first and second groove, the upper cover defines a third and fourth groove, the first receiving room is formed by the first and third grooves, the second receiving room is formed by the second and fourth grooves.

8. A cable assembly, comprising:

a housing defining a pair of first receiving rooms disposed at two sides therein and a pair of second receiving rooms located between the pair of first receiving rooms, the housing further defining a pair of mounting platforms extending outward respectively from two lateral sides thereof along a transversal direction;

a pair of first electrical connectors received into the first receiving room, a pair of second electrical connectors received into the second receiving room, each first electrical connector including a metallic shell;

a plurality of cables electrically connected with the first and second electrical connectors; and a pair of grounding pieces assembled to the housing, each grounding piece having a body portion surrounding the mounting platform and a contacting arm extending into the first receiving room along a transversal direction and contacting with the metallic shell of the first electrical connector.

9. The cable assembly as recited in claim 8, wherein the housing includes a lower cover and an upper cover locked with the lower cover.

10. The cable assembly as recited in claim 8, wherein the body portion of the grounding piece defines a through hole in alignment with a mounting hole formed in the mounting platform.

11. The cable assembly as recited in claim 9, wherein the lower cover has a plurality of positioning posts, the upper cover has a plurality of positioning holes, the positioning posts are received into the positioning holes.

12. The cable assembly as recited in claim 9, wherein the lower cover has a plurality of latching portions engaged with a plurality of corresponding engaging piece formed on the upper cover.

13. The cable assembly as recited in claim 8, wherein the body portion of the grounding piece further defines a pair of locking tabs respectively received into a pair of fixing slots of the mounting platform.

14. A cable connector assembly comprising:

an insulative housing defining a receiving room with an opening to communicate with an exterior along a front-to-back direction;

a mounting platform unitarily extending from one lateral side of the housing for mounting to an external part;

an electrical connector having a metallic shell thereon and received in the receiving room; and a grounding piece assembled to the platform; wherein said grounding piece includes an elastic arm extending inward into the receiving room and mechanically and electrically engaging the shell; wherein said grounding piece is configured to be assembled to the platform only along a lateral direction perpendicular to said front-to-back direction.

15. The cable connector assembly as claimed in claim 14, wherein a through hole extends through both said grounding piece and said mounting platform.

16. The cable connector assembly as claimed in claim 15, wherein said elastic arm extends along a lateral direction perpendicular to said front-to-back direction.

17. The cable connector assembly as claimed in claim 3, wherein the body portion of the grounding piece and the mounting platform both has a mounting hole in alignment with each other along a vertical direction.

* * * * *